US007510133B2

(12) United States Patent
Pallmann

(10) Patent No.: US 7,510,133 B2
(45) Date of Patent: Mar. 31, 2009

(54) APPARATUS FOR COMMINUTING MATERIAL HAVING A COOL AIR CHANNEL

(75) Inventor: Hartmut Pallmann, Zweibruecken (DE)

(73) Assignee: Pallmann Maschinenfabrik GmbH & Co., KG, Zweibruecken (DE)

( * ) Notice: Subject to any disclaimer, the term of this patent is extended or adjusted under 35 U.S.C. 154(b) by 589 days.

(21) Appl. No.: 11/249,439

(22) Filed: Oct. 14, 2005

(65) Prior Publication Data

US 2006/0086846 A1 Apr. 27, 2006

(30) Foreign Application Priority Data

Oct. 14, 2004 (DE) ..... 10 2004 050 003

(51) Int. Cl.
*B02B 1/00* (2006.01)
*B02C 11/08* (2006.01)
*B07B 4/00* (2006.01)

(52) U.S. Cl. ..... 241/39; 241/5; 241/67

(58) Field of Classification Search ..... 241/39, 241/5, 40, 66, 67

See application file for complete search history.

(56) References Cited

U.S. PATENT DOCUMENTS 2,176,142 A * 10/1939 Merges et al. ..... 241/67
3,302,893 A 2/1967 Feder et al.
3,584,799 A 6/1971 Feder

FOREIGN PATENT DOCUMENTS

DE 360 295 10/1922

* cited by examiner

*Primary Examiner*—Bena Miller
(74) *Attorney, Agent, or Firm*—Muncy, Geissler, Olds & Lowe, PLLC

(57) ABSTRACT

An apparatus for comminuting material is provided. The apparatus includes two disks, which are arranged coaxially to one another inside a housing that encloses a comminuting room. The rim areas of the disks are positioned opposite one another, thus forming a milling gap, and are provided with interacting comminuting tools. To generate a mutual relative movement of the disks, at least one of the disks carries out a rotational motion around the mutual axis. To comminute the material, it is first fed into the comminuting room and subsequently radially channeled to the milling gap. For additional cooling, the disk on the intake side is arranged at an axial distance to the intake side of the housing front wall, thus forming a ringwheel-shaped cool air conduit. This can be charged with cool air, which flows through the conduit in a radial direction. In this way, the machine capacity can be increased without causing thermal damage to the material to be processed.

22 Claims, 5 Drawing Sheets

APPARATUS FOR COMMINUTING MATERIAL HAVING A COOL AIR CHANNEL

This nonprovisional application claims priority under 35 U.S.C. § 119(a) on German Patent Application No. DE 102004050003.7, which was filed in Germany on Oct. 14, 2004, and which is herein incorporated by reference.

BACKGROUND OF THE INVENTION

1. Field of the Invention

The present invention relates to an apparatus for comminuting material having a cool air channel.

2. Description of the Background Art

During the comminuting of materials in conventional devices, a considerable part of the energy required for the comminuting is converted into heat. This is caused by friction and impact forces the materials are subjected to during the comminuting process, and which primarily affect the comminuting tools.

A characteristic of conventional devices during operation is air flow, which, apart from the centrifugal force, is the force that moves the materials. This so-called self-ventilation can be generated by the device itself and/or initiated from the outside. If the material is not heat-sensitive, the innate self-generated flow of air in conventional devices is sufficient to cool down the comminuting tools such that any adverse effects on the material are eliminated.

Problems occur on a regular basis, when heat-sensitive materials are to be comminuted. Especially when plastics with a low melting point are to be comminuted, operators of conventional devices face a difficult task. On the one hand, the milling of the material is to be done at barely below the melting point in order to attain as high a machine output as possible. If the material-dependent temperature limit is thereby exceeded, the material softens and begins to melt with the result that individual particles bake together such that the size of the particles and the particle distribution of the milled material are no longer within the desired range. On the other hand, the overheated particles bake onto the machine parts, particularly the milling tools, so that the machine efficiency as well as the quality of the finished product leave much to be desired.

This problem is compounded when fine-milling heat-sensitive materials because it was found that the finer the finished product is to be, the more comminuting work has to be done, and the greater the heat generation in the area of the comminuting tools will be.

To avoid thermal overstress of the material during the comminuting process, it is common to lower the machine output of comminuting devices. In this way, less comminuting work is done per unit of time, thus generating less excess heat. However, as a consequence, the comminuting apparatus does not operate at full capacity, which goes against the fundamental requirements for an economical operation of such devices. One conventional solution is to increase the air volume beyond the self-ventilation of a conventional comminuting device by adding blowers in order to be able to vent additional heat.

Moreover, a device is known from DE 360 295 A1 having two axially spaced milling disks for forming a milling gap. The disk on the material-intake side is rigidly attached to the housing and is provided with openings for feeding the material into the device. The rear disk is positioned on a drive shaft to execute a rotational movement. For additional cooling, the rear disk is thick-walled and provided with a hollow space. The drive shaft, which is formed as a hollow shaft, has two channels, one of which feeds cooling fluids into the hollow space, whereas the other serves as the return line for the cooling fluids from the hollow space.

From U.S. Pat. No. 3,302,893, a device is known, wherein two axially opposed and rotating milling disks form a radial milling gap. The disk at the material-intake side has two openings to feed the material to the milling gap. The drive shaft for the rear milling disk is a hollow shaft for forming a cooling channel, from which cooling lines that are arranged in a star-shaped pattern in the area of the rear disk, lead to the comminuting tools. Cooling fluids from the cooling lines are directed to the area of the comminuting tools.

An additional device of this class is disclosed in U.S. Pat. No. 3,584,799. A milling disc rotates opposite a stationary milling ring, which is arranged at the intake side of the housing. The stationary milling ring is cooled with cool water, which is introduced via an annular groove in the housing, and distributed.

The disadvantage of this device is the need to provide a further cooling medium in addition to air. The additional technical expenditure necessary for storing, cooling, and conveying the cooling medium makes this device costly, in regard to both acquisition and operation.

SUMMARY OF THE INVENTION

It is therefore an object of the present invention to increase the machine efficiency of conventional devices without thereby exposing the material to additional thermal stress.

A first benefit of the invention is that in addition to cooling the milling gap with self-generated air, additional cool air is introduced into the device in accordance with the present invention. The thus increased air volume makes it possible to discharge additional heat so that the comminuting tools and the materials to be milled are exposed to considerably less heat. This allows the improvement of the operational performance, and thus also the cost effectiveness of devices of the present invention.

An additional benefit is derived from using air as a cooling medium. Air is available free of charge and in unlimited quantities everywhere, and can be introduced in a simple way via the openings in the intake side of the front housing wall, for example. After the heat transfer from the comminuting tools into the cool air, it can be released into the ambient air without much effort, after first filtering out the milled material, if necessary. This does not require much in technical equipment so that cool air can be utilized very economically as a cooling medium. Furthermore, air is neutral to the material, that is, it does not alter its chemical or physical characteristics.

In a beneficial embodiment of the invention, the openings on the intake side for feeding the cool air conduit with cool air are connected to one another via an annular channel. This simplifies the construction, particularly in connection with the use of cool or compressed air, which otherwise would have to be channeled individually to each opening.

To improve the heat transfer from the disks into the cool air, it is suggested in a preferred embodiment of the invention to provide radial ribs in the cool air conduit, which are mounted to the disk that is located at the intake side. The cooling effect thus achieved occurs in stationary, as well as in rotating milling disks. An additional feature of the rotating milling disks is that the radial ribs cause an outward radial movement of the cool air stream. Thus, the radial ribs support the cool air flow.

It is thereby beneficial for the radial ribs to extend nearly across the entire width of the cool air conduit in order to make available as large an area as possible to the cool air for heat exchange. In combination with rotating disks, larger radial ribs have the additional benefit of higher tractive power of the cool air flow.

By arranging the radial ribs near the comminuting tools, the location of the heat generation and the location of the heat removal are in close proximity to one another, which results in an optimized heat removal. In this way, excess heat is very quickly and efficiently removed.

In a further embodiment of the invention, air-conducting elements are arranged in the cool air conduit, which ensure a flow path that is effective for the cooling down of the comminuting tools. It is thereby achieved that the cool air brushes over the areas of the disk that are affected the most by the excess heat. Since the cooling potential of the cool air is thus fully utilized, the best possible cooling effect is thereby achieved.

The geometric shape of the air-conducting elements can be such that the air stream follows the geometry of the surface of the disk. When the surface of the disk is not even, the flow path and thus the contact time between cool air and disk is extended, resulting in a high heat transfer. This measure is of particular importance with devices of the present invention that have a milling gap that is tilted towards a radial plane, and/or an existing intake cone.

Preferably, the air-conducting elements are provided in the area of the radial ribs in order to obtain an interaction of radial ribs and air-conducting elements, particularly with rotating disk. In this way, the supportive effect of the radial ribs on the cool air flow is increased.

An air-conducting element that is suitable for this purpose has a trapezoidal cross section and is annularly arranged around the axis of rotation. This takes into account aerodynamic considerations on the one hand, and on the other hand, allows the ring surface, which is located opposite the trapezoidal base, to interact with the radial ribs.

According to a particularly beneficial embodiment of the present invention, a further cool air conduit is provided in a corresponding fashion between the rear wall of the housing and the rear disk. Thereby, the comminuting tools that are arranged on the rear disk are also cooled. In this way, a symmetrical and thus even cooling of all comminuting tools is achieved. The comminuting tools are thereby cooled down on their active side by the self-generated air flowing through the milling gap, and on the opposite outer side by the cool air flowing through the cool air channel. Thus, the greatest-possible heat removal of a device of the present invention is achieved.

In a preferred embodiment of the present invention, the comminuting room is divided into two chambers. One chamber is thereby entirely dedicated to the material and the second chamber exclusively to the cool air. This allows an independent supply of the device with material or with cool air, which further optimizes the comminuting process.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description. For example, the illustrated embodiment relates to a disk mill having an inclined milling gap, however, the invention is also applicable to disk mills with a radial milling gap, pin mills, refiners, etc.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
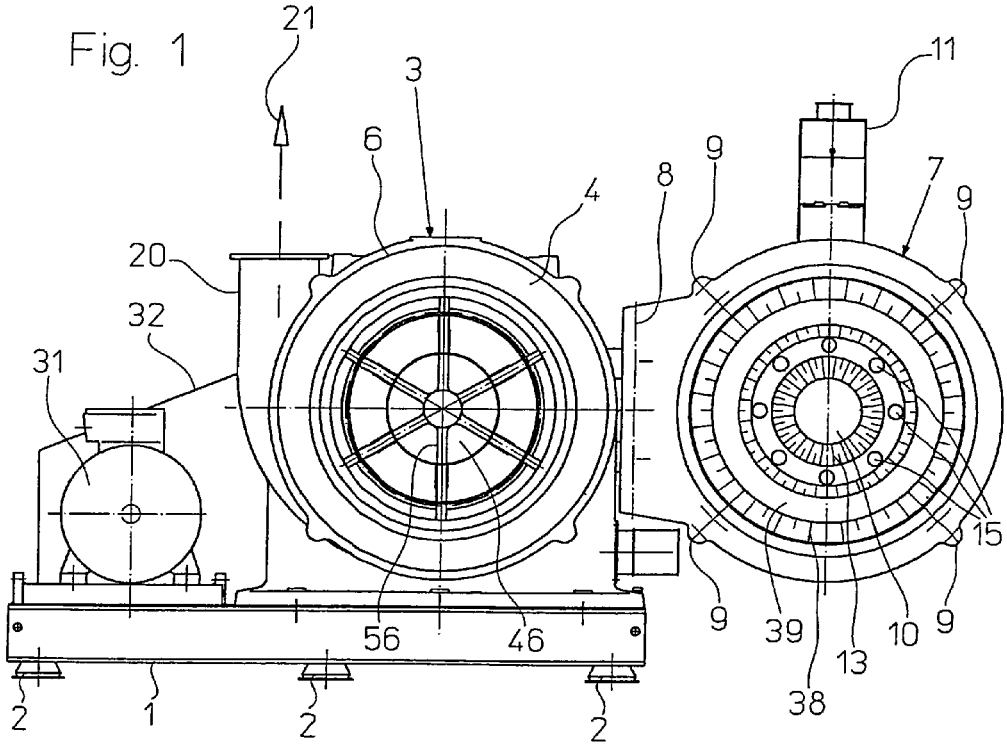
FIG. 1 is a front view of a device of the present invention, with the housing door open.
Figure 4:
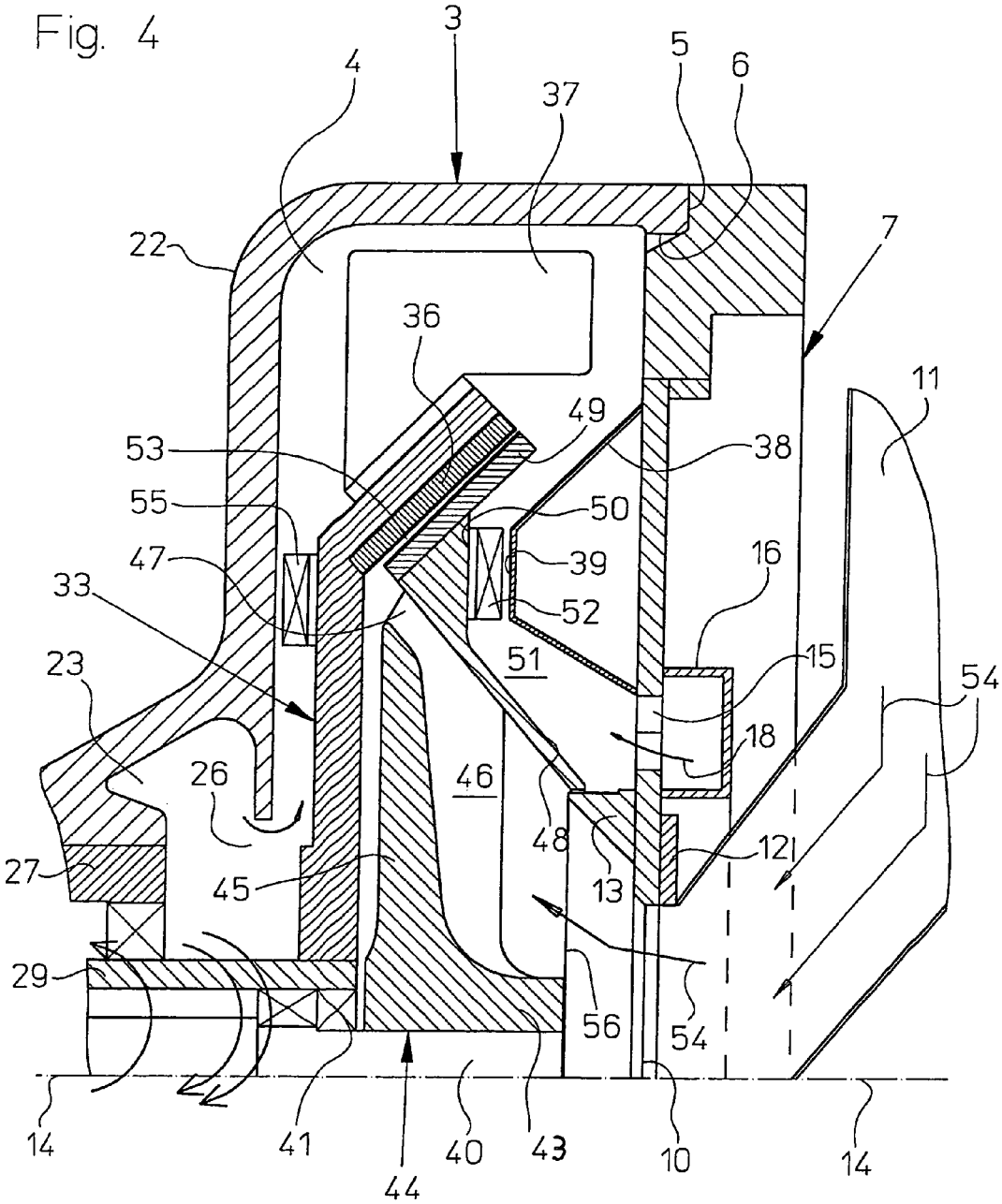
FIG. 4 is a partial cross section of the upper part of the device illustrated in FIG. 3.

FIGS. 1 and 4 illustrate the detailed construction of an apparatus of the present invention. To begin with, FIGS. 1 and 2, which show a front view of the device with the housing door 7 open and closed, respectively, illustrate a machine substructure 1, the feet 2 of which rest on the ground/floor. The upper part of the machine substructure 1 forms a platform, on which the comminuting apparatus of the present invention is mounted.

The comminuting apparatus includes a drum-shaped housing 3 about an axis 14, and which encloses a comminuting room 4. On its front side 5, the housing 3 has a central circular opening 6, which can be closed with a housing door 7 that is pivotable around a vertical axis 8 and can be bolted shut with bolts 9.

The housing door 7 also has a central circular feeder opening 10, into which a chute 11, connected by a flange 12, terminates, the chute extending from the outside in a vertical direction, and in the bottom area in a transverse direction. From the interior of the housing door 7 is a short, conically expanding connecting piece 13, which encloses the rim of the feeding opening 10.

Figure 3:
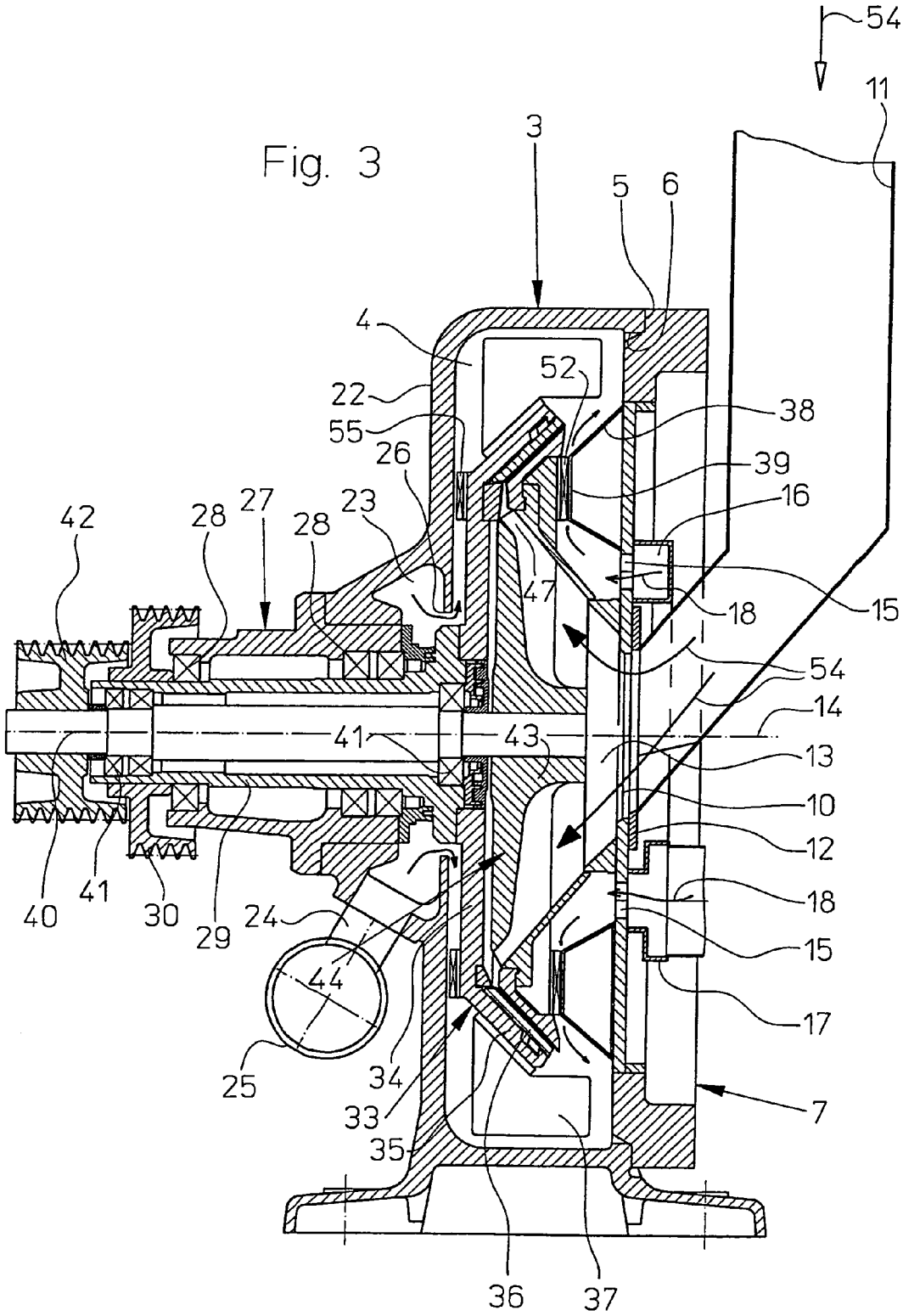
FIG. 3 is a vertical cross section along the line III-III of the device illustrated in FIG. 2.

Furthermore, the housing door 7 has a plurality of equally spaced openings 15, which are located on a circumference that is concentric to the axis 14, and which connect the comminuting room 4 with the exterior of the mill. A ring channel 16, which also extends concentrically to the axis 14, covers the openings 15 on the exterior of the housing door 7, thus connecting them with one another. The ring channel 16 is fixedly attached to the housing door 7 and has a connector 17 in the lower apex, through which air can be introduced from an air conditioning system (not illustrated). The flow of the cool air is indicated by the arrows 18 (FIG. 3).

On the inner side of the housing door 7, in the area between the openings 15 and the edge of the housing door 7, an annular air-conducting element 38, which is also arranged concentrically to the axis 14, is shown. The air-conducting element 38 is formed by a sheet of metal with a trapezoidal cross section, which is attached to the inner side of the housing door 7 with its larger base. When the housing door 7 is closed, the side opposite the base of the air-conducting element 38 forms a ring surface 39, which extends in a radial plane into the comminuting room 4.

Figure 2:
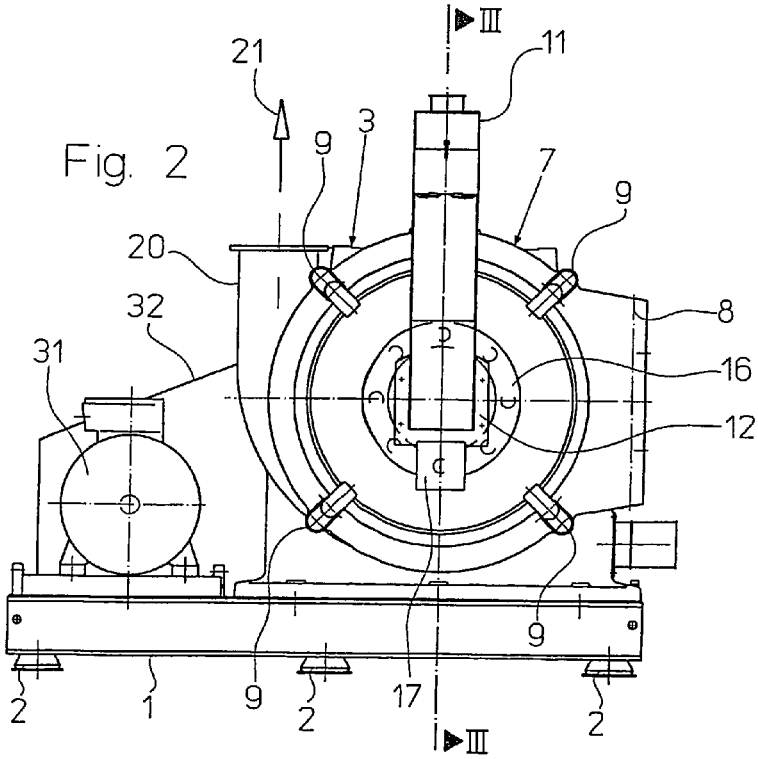
FIG. 2 is a front view of the device illustrated in FIG. 1, with the housing door closed.

The finely-milled material 21 is discharged via a material discharge 20, which in the illustration plane of FIGS. 1 and 2 extends tangentially upwards from the housing 3, and to which a suction device can be attached, for example. Alternatively, the material discharge 20 can extend in other directions as well.

The rear wall 22 of the housing 3 is reinforced in order to form an annular ring channel 23, which is located in a radial plane to the axis 14, on the one hand, and, in the area of the axis 14, to form a horizontal bearing area 27 with bearing groups 28 on the other hand. The ring channel 23 is connected to a cool air system 25 via a connector 24. The cool air channel 23 is connected to the comminuting room 4 via a plurality of openings 26 in the rear wall 22, which are located on a peripheral line around the axis 14.

Through the rear wall 22 extends a shaft 29, which can be hollow, and which is rotatably positioned in the bearing groups 28, and with its front end reaches into the comminuting room 4, with, for example, a multiple-groove pulley 30 attached to its exterior end. The multiple-groove pulley 30 can be connected by straps to the drive motor 31, which is only illustrated in FIGS. 1 and 2. The straps extend thereby inside protective sheathing 32.

At the opposite end of the hollow shaft 29 that is located in the comminuting room 4, a first disk 33 is mounted. The disk 33 has a central area 34, which is level in a radial plane. In contrast, the rim area 35 adjacent thereto in a radially outward direction is angled towards the front housing side 5 in the shape of a dinner plate. On the inside of the bent rim area 35, comminuting tools 36 are arranged in the shape of a milling ring. On the side opposite from the rim area 35, air blades 37, which extend radially in the area between the disk 33 and the circumference of the housing 3, are mounted.

In addition, a plurality of radially extending ribs 55 are provided in an outer peripheral area of the central area 34 of the disk 33, which are fixedly connected to the disk 33. The ribs extend nearly across the entire width of the gap between the disk 33 and the rear wall 22 of the housing. For example, the ribs 55 can be 5-25 mm high and can be arranged at mutual circumferential intervals of 20-100 mm.

Inside the hollow shaft 29, an additional drive shaft 40 is rotatably positioned in the bearing groups 41. The rearward end of the drive shaft 40, which runs horizontally through the rear wall 22 of the housing, also has a multi-groove pulley 42 for connecting to an additional electric motor. At the end of the drive shaft 40 extending into the comminuting room 4, a second disk 44 is seated by its hub 43 (FIG. 4). The first disk 33 and the second disk 44 are arranged coaxially to one another and rotate around a mutual axis 14.

As can be particularly seen in FIG. 4, adjacent to the hub 43 of the second disk 44 and extending in a radial direction is an essentially plane disk element 45, which is separated into several sector-shaped partitions 46 that are bound by radial tie bars 56. On the front side of the disk element 45 in close proximity to the axis, the partitions 46 form trenches, which radially outwards form channels 47, which allow the passing of material from the front to the rear side of the second disk 44.

To assure that the entire material reaches the channels 47, a concentric, truncated hollow cone 48 is arranged on the front side of the disk element 45, the base of which connects to the trenches in the area of the sector-shaped partitions 46. With its narrow opening, the truncated hollow cone 48 forms a gliding connection to the hollow cylinder-shaped connecting piece 13. The rim area of the second disk 44 supports the comminuting tools 49, which are positioned at a parallel distance opposite the comminuting tools 36 of the first disk 33. In this way, a milling gap 53 is formed that is tilted toward a radial plane.

Between the truncated hollow cone 48 and the comminuting tools 49, on the side that is assigned to the housing door 7, the second disk 44 has a plane ring surface 50, which extends at the same radial distance to the axis 14 as the ring surface 39 of the air-conducting element 38. Starting at the openings 15 in the housing cover 7 between air-conducting element 38 and the truncated hollow cone 48, the ring surface 50 as well as the comminuting tools 49 of the second disk 44, a cool air conduit 51, through which cool air can flow radially, is thus formed.

On the ring surface 50 of the second disk 44, a plurality of ribs 52, which are radially oriented and extend nearly across the entire width of the cool air conduit 51, that is, almost all the way to the ring surface 39, are evenly distributed around the circumference. For example, the ribs 52 can be 5-25 mm high and can be arranged at mutual peripheral intervals of 20-100 mm.

In practical application, a device of the present invention works as follows: With the disks 33 and 44 counter-rotating, or rotating unidirectional with rotational speed difference, the material indicated by arrows 54 is introduced into the chute 11. In this way, it is conveyed, via the feeder opening 10, to the comminuting room 4, where it first encounters, in an axial direction, the second disk 44. There it is received by the recessed partitions 46. As a result of the rotating of the disk 44, it is rerouted by centrifugal forces into a radial direction and then flows through the channels 47, which subsequently transport it to the milling gap 53. In the milling gap 53, the material 54 is comminuted by impact and friction forces generated by the comminuting tools 36 and 49. Part of the energy supplied to the device is thereby converted into heat. After exiting the milling gap 53, the milled material, together with the air generated by the radial air blades 37 while rotating around the axis 14, arrives at the peripheral area of the housing 3, which it exits tangentially through the material discharge 20.

The heat generated during the comminuting process causes the comminuting tools 36 and 49 to heat up, whereby a part of this heat is transferred to the first disk 33 and/or the second disk 44 due to heat conduction. A first cooling of the comminuting tools 36 and 49 occurs through self-generated air, which, together with the material 54, flows through the device, including the area of the milling gap 53.

An additional cooling of the first disk 33 is accomplished by introducing cool air from the air conditioning system 25 via the connector 24 into the ring channel 23. From there, the cool air flows through the openings 26 into the ring-wheel shaped gap between the real wall 22 of the housing and the first disk 33, from where it flows along the ribs 55 radially outward, whereby a heat transfer from the ribs 55 into the cool air takes place. The ribs 55 rotating with the disk 33 thereby generate an additional propulsion impulse onto the cool air.

On the front side 5 of the device, cool air 18 flows into the annular channel 16 via the connector 17. In the annular channel 16, a distribution of the cool air 18, and thus an even supply of the openings 15 with cool air 18, takes place so that cool air 18 is evenly distributed through the openings 15 into the cool air conduit 51, through which it flows radially. The cool air 18 brushing by the radial ribs 52 thereby absorbs heat, at the same time receiving a motion impulse from the radial ribs 52 that are brushing past the ring surface 39 at close proximity. The heat-loaded cool air 18 exits the housing 3 via the material discharge 20, together with the self-generated air and the milled material.

Figure 5:
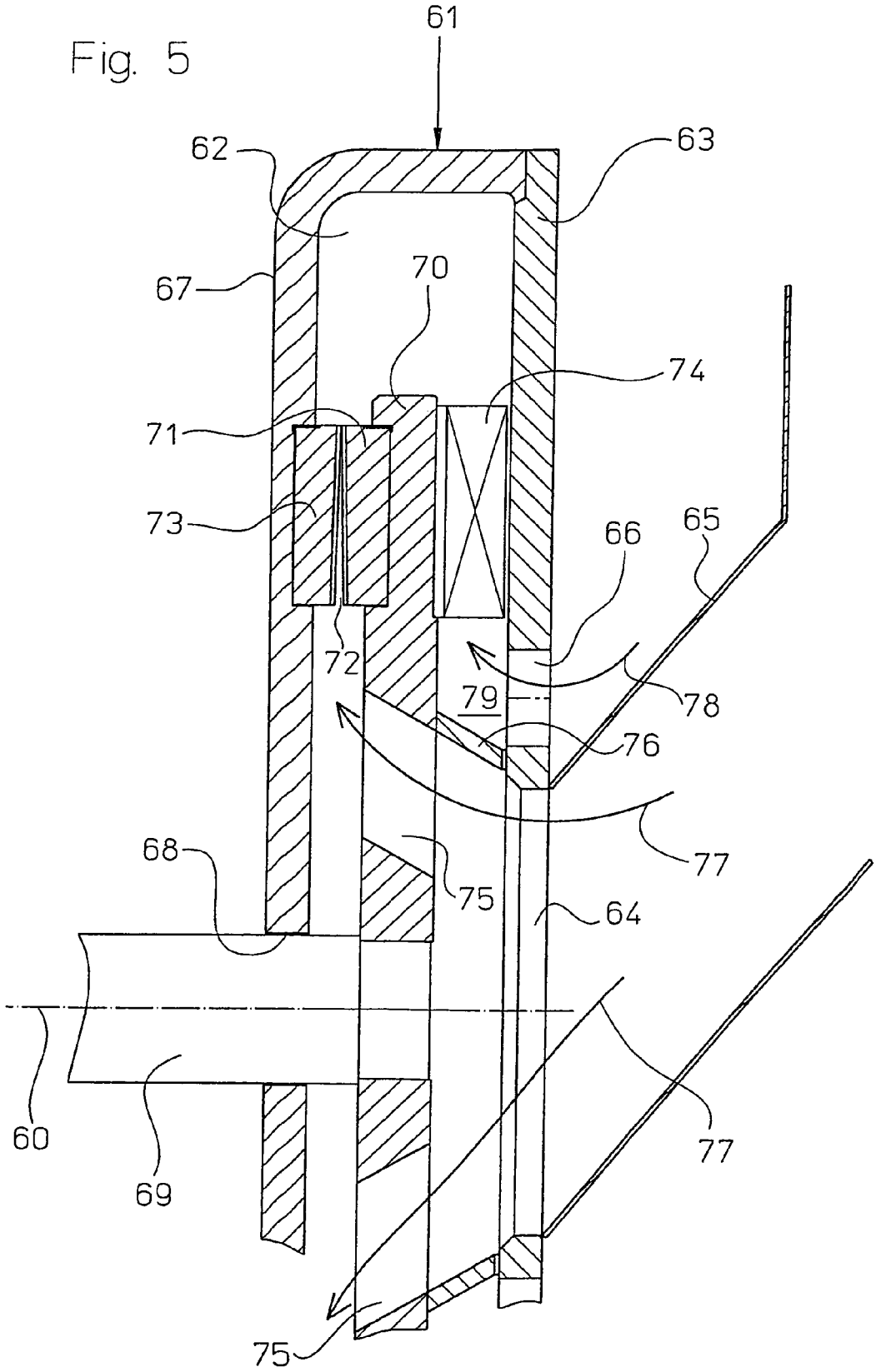
FIGS. 5 and 6 each illustrate a partial cross section of the upper part according to a further embodiment of the present invention.

FIG. 5 shows the application of the invention to a mill construction, whereby one milling ring is stationary and the other milling ring is rotating. Otherwise, the mill is rather identical with the mill described in FIGS. 1 to 4 so that the description thereof applies here also.

Illustrated in detail is a drum-shaped housing 61 encircling an axis 60 and enclosing a comminuting room 62. On its front side, the housing 61 is accessible via a housing cover 63, which can be swung open for this purpose. In its center, the housing cover 63 has a feeder opening 64, adjacent to which is a chute 65 (only partially shown) for feeding material into the mill.

In addition, there are a plurality of openings 66, which are arranged at equal intervals on a periphery that is concentric to the feeder opening 64. In the area of the axis 60, the rear wall 67 of the housing has an aperture 68 for a horizontal drive shaft 69. The mounting and powering of the drive shaft 69 are essentially the same as described in FIGS. 1 and 4.

Mounted to the end of the drive shaft 69, which is located in the comminuting room 62, is a disk 70 arranged in a radial plane. The outer rim of the disk facing the rear wall 67 of the housing is provided with a first milling ring 71. In order to form a milling gap 72, a second milling ring 73 is arranged opposite the first milling ring 71 in an axial distance on the inner side of the rear wall 67 of the housing.

The opposite rim section of the disk 70 facing the housing cover 63 has a plurality of radial ribs 74 that are evenly distributed around the periphery. The radial ribs 74 thereby extend almost across the entire width of the annular chamber, which is located between the disk 70 and the housing cover 63, forming a cool air conduit 79.

In the area between the outer rim segment and the drive shaft 69, there are material passages 75, which connect the front and rear sides of the disk 70. In order to direct the material flow to the material passages 75, a truncated hollow cone 76 is attached to the disk 70 on the intake side and concentric to the axis 60, which forms a gliding connector to the feeder opening 66 of the housing cover 63.

As is illustrated in FIG. 5, with the disk 70 rotating, the material indicated by arrows 77 is channeled through the feeder opening 66 into the comminuting room 62 during operation. From there, guided by the truncated hollow cone 76, it travels through the material passages 75 to the area between the disk 70 and the rear wall 67 of the housing, where it is fed by centrifugal forces into the milling gap 72, and thereby milled. The milled material is removed from the comminuting room via a material discharge (not shown).

To cool down the milling ring 71, a stream of cool air indicated by arrow 78 is channeled through the mill of the present invention. Cool air 78 is thereby drawn through the openings 66 in the housing cover 63 and channeled into the cool air conduit 79 formed by the disk 70 and the housing cover 63. Due to the prevailing centrifugal forces and pressure conditions, the cool air stream 78 is rerouted radially outwards, thereby brushing along the radial ribs 74. Thereby, a heat transfer from the radial ribs 74 to the cool air stream 78 takes place so that excess heat is removed from the mill in this way.

It is noted that the present invention is also applicable to embodiments of mills, whereby the milling gap extends between the rotating milling disk and the housing door. In these instances, the milling ring on the material-intake side is arranged in an axial distance to the housing door for forming a cool air conduit so that, in turn, radially extending cooling ribs can be mounted in the area of the milling ring to offset an overheating of the comminuting tools, and thus the material.

Figure 6:
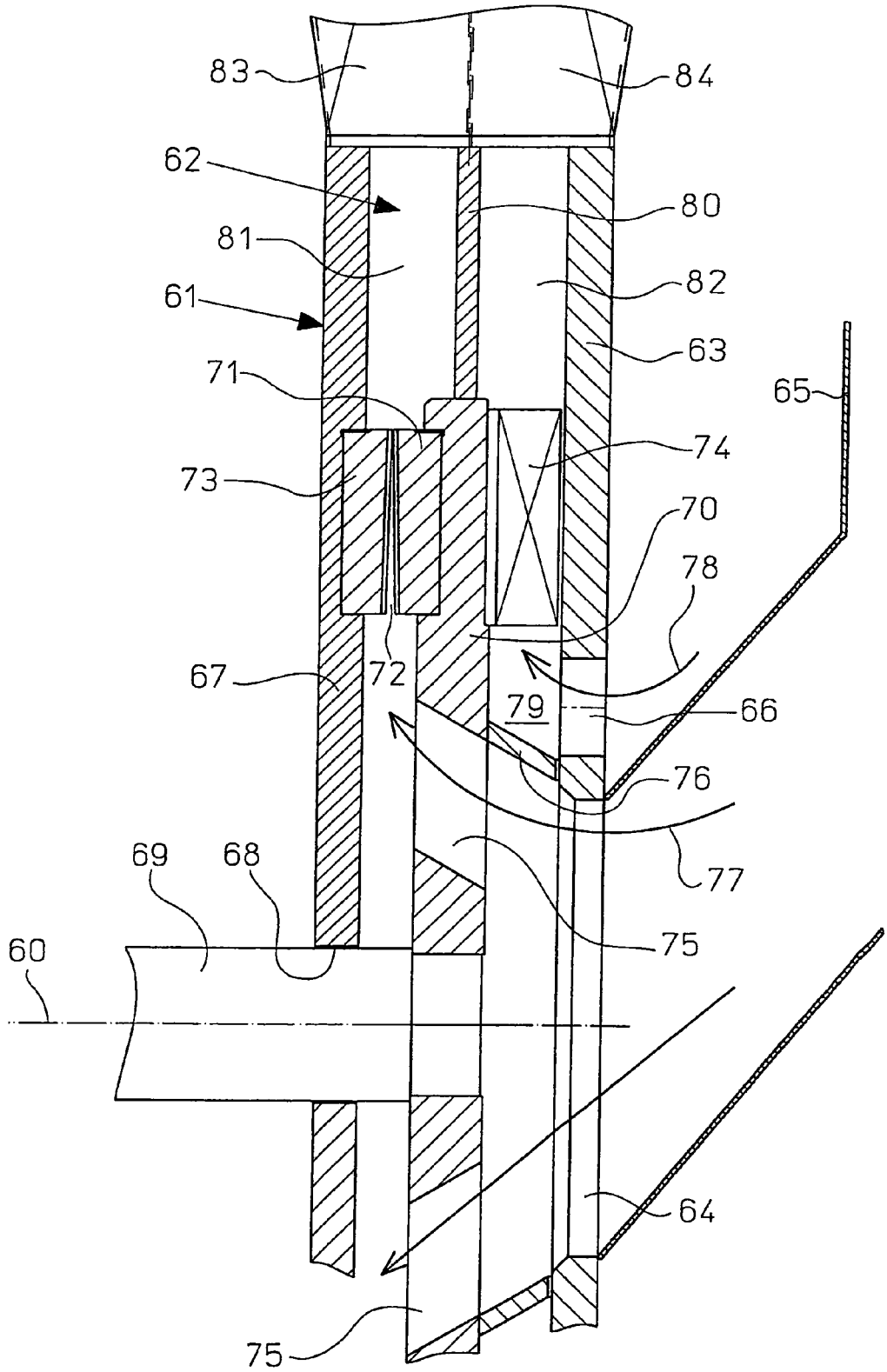

FIG. 6 is, for the most part, identical to the embodiment illustrated in FIG. 5 so that the same reference numerals indicate the same components, and reference is made to the corresponding part of the description.

Otherwise, the embodiment of the invention illustrated in FIG. 6 differs such that the comminuting room 62 is formed like a chamber. For this purpose, the peripheral side of the disk 70 is surrounded by a coaxial ring wheel 80. With its outer periphery, the ring wheel 80 is fixedly connected to the housing 61, whereas its inner periphery forms a gliding connection to the disk 70. In this way, a partition arranged in a radial plane is formed in the comminuting room 62, comprised of the disk 70 and the ring wheel 80, the partition dividing the comminuting room 62 into a first disk-shaped chamber 81 and a second disk-shaped chamber 82. Consequently, this partition also continues into the material discharge 20 (FIG. 1). In the area of the material discharge, a first pipe line 83 is connected to the chamber 81, and a second pipe line 84 is connected to the chamber 82. The pipe line 83, for example, can lead to a filter device (not shown), where a separation of the gaseous phase of the material 77 from the solid phase takes place. The pipe line 84 can lead directly into the ambient air.

The advantage of such a device in practical application is that the material 77, a combination of gaseous and solid material, which is fed into the comminuting room 62 does not mix with the additional cool air 78 that is channeled into the comminuting room 62. Rather, the material 77 and the cool air 78 pass through the comminuting room 62 in two spatially separate systems so that for the extraction of the milled material as the end product, it is merely necessary to channel the gaseous and solid material mixture of the material 77 passing through the chamber 81 through subsequent filter devices. The cool air 78 flowing through the chamber 82 can directly and without additional measures be discharged into the ambient air. The thus reduced volume to be filtered allows the employment of smaller filters.

It goes without saying that the chamber-like construction of the comminuting room 62 is also possible in comminuting devices of this class that have two rotating disks, whereby cool air is channeled into the comminuting room from the front as well as from the rear, similar to the embodiments illustrated in FIGS. 1 to 4. In such an instance, the comminuting room 62 is divided into three corresponding chambers, whereby the one in the middle is designated for the self-generated air and solid material part, whereas the remaining chambers, which are adjacent to each side in an axial direction, are exclusively dedicated to cool air for the comminuting tools, with the resulting benefits as previously described.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An apparatus for comminuting material comprising:

a housing substantially enclosing a comminuting room;

a first disk and a second disk being arranged coaxially to one another inside the housing, the first disk and second disk each having rim areas with comminuting tools that are located opposite one another thereby forming a milling gap, at least one of the first or second disk is executing a rotational motion around a mutual axis, the material being axially fed into the comminuting room and radially channeled to the milling gap; and a ringwheel-shaped cool air conduit being formed between an arrangement of the disk on an intake side and an intake side of the housing front wall, which is arranged at a axial distance to the disk, the ringwheel-shaped cool air conduit facilitating cool air flow in a radial direction into the apparatus.

2. The apparatus according to claim 1, wherein the intake side of the housing wall has at least one opening for supplying the cool air conduit with cool air, the opening terminating in the cool air conduit.

3. The apparatus according to claim 1, wherein, in the intake side of the housing wall, a plurality of openings are arranged on a circular path around the mutual axis and an annular channel is arranged in front of the openings, from where the openings are supplied with the cool air.

4. The apparatus according to claim 1, wherein radial ribs are arranged on the intake side of the disk and extend into the cool air conduit.

5. The apparatus according to claim 4, wherein the radial ribs extend substantially across a width of the cool air conduit.

6. The apparatus according to claim 4, wherein the radial ribs are arranged at a height level of the comminuting tools.

7. The apparatus according to claim 4, wherein air-conducting elements are arranged in the cool air conduit to direct the cool air stream.

8. The apparatus according to claim 7, wherein the air-conducting elements reduce the flow-through diameter for the cool air.

9. The apparatus according to claim 8, wherein the air-conducting elements have a trapezoid cross section and extend annularly around the mutual axis.

10. The apparatus according to claim 1, wherein a rear disk and the rear wall of the housing are arranged at an axial distance to one another for forming a second ringwheel-shaped cool air conduits that can be supplied with cool air.

11. The apparatus according to claim 10, wherein, for supplying the second cool air conduits with cool air, the rear wall of the housing is provided with at least one opening, which terminates in the cool air conduit.

12. The apparatus according to claim 10, wherein a plurality of openings are arranged in a circular manner around the mutual axis in the rear wall of the housing, and wherein an annular channel is arranged in front of the openings from where the openings are supplied with cool air.

13. The apparatus according to claim 10, further comprising radial ribs that extend into the cool air conduit, the radial ribs being arranged on the rear disk.

14. The apparatus according to claim 13, wherein the radial ribs extend substantially across a width of the cool air conduit.

15. The apparatus according to claim 13, wherein the radial ribs are mounted at a height level of the comminuting tools.

16. The apparatus according to claim 1, wherein the milling gap is inclined toward a radial plane.

17. The apparatus according to claim 1, wherein on one of the first and second disks further include air blades that extend radially towards an outer periphery of the housing.

18. The apparatus according to claim 1, wherein the comminuting room is partitioned into a first chamber through which a mixture of gaseous and solid material passes and into at least one further chamber through which cool air flows.

19. The apparatus according to claim 18, wherein, for partitioning the comminuting room, at least one wall is provided, which is arranged in a plane that is radial to the axis.

20. The apparatus according to claim 19, wherein the wall is formed by one of the first or second disks, with the ring wheel radially adjacent thereto.

21. The apparatus according to claim 18, wherein one of the first or second disks is stationary and is formed by the front wall or the rear wall of the housing.

22. The apparatus according to claim 21, wherein the intake side of the housing wall forms the stationary disk.

* * * * *